US008818587B1

(12) United States Patent
Arbuckle et al.

(10) Patent No.: US 8,818,587 B1
(45) Date of Patent: Aug. 26, 2014

(54) SYSTEMS AND METHODS FOR CONTROLLING MOVEMENT OF PROPULSION UNITS ON A MARINE VESSEL

(71) Applicant: Brunswick Corporation, Lake Forest, IL (US)

(72) Inventors: Jason S. Arbuckle, Horicon, WI (US); Thomas S. Kirchhoff, Fond du Lac, WI (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 87 days.

(21) Appl. No.: 13/738,642

(22) Filed: Jan. 10, 2013

(51) Int. Cl.

| | |
|---|---|
| ***B63H 20/08*** | (2006.01) |
| ***B63H 21/21*** | (2006.01) |
| ***B63H 25/02*** | (2006.01) |
| ***B63H 20/00*** | (2006.01) |
| ***B63H 20/12*** | (2006.01) |
| ***B63H 5/125*** | (2006.01) |
| ***B63H 25/42*** | (2006.01) |
| *B63H 25/00* | (2006.01) |

(52) U.S. Cl.

CPC ..... *B63H 21/21* (2013.01); *B63H 21/213* (2013.01); *B63H 25/02* (2013.01); *B63H 21/265* (2013.01); *B63H 20/12* (2013.01); *B63H 2020/003* (2013.01); *B63H 5/125* (2013.01); *B63H 20/08* (2013.01); *B63H 21/26* (2013.01); *B63H 25/42* (2013.01); *B63H 25/00* (2013.01)

USPC ..... 701/21; 440/53; 440/57; 703/2; 702/94; 702/105; 702/151

(58) Field of Classification Search

CPC .... B63H 21/213; B63H 25/02; B63H 21/265; B63H 20/12; B63H 2020/003; B63H 5/125; B63H 20/08; B63H 21/26; B63H 25/00; B63H 25/42; B63H 2020/08; B60F 3/0007

USPC ..... 701/21; 114/144 R, 285; 440/53, 57, 58; 702/94, 105, 150, 151; 703/2, 6, 8

See application file for complete search history.

(56) References Cited

U.S. PATENT DOCUMENTS

| | | | | |
|---|---|---|---|---|
| 4,355,985 | A * | 10/1982 | Borst et al. | 440/51 |
| 4,993,349 | A * | 2/1991 | Solari | 114/289 |
| 6,148,756 | A * | 11/2000 | Pavlov et al. | 114/280 |
| 6,469,664 | B1 * | 10/2002 | Michaelson et al. | 342/357.31 |
| 6,750,815 | B2 * | 6/2004 | Michaelson et al. | 342/357.31 |
| 6,913,497 | B1 | 7/2005 | Ahlswede et al. | |
| 7,267,588 | B1 | 9/2007 | Griffiths et al. | |
| 7,416,458 | B2 * | 8/2008 | Suemori et al. | 440/53 |
| 7,467,595 | B1 | 12/2008 | Lanyi et al. | |
| 7,769,504 | B2 * | 8/2010 | Kaji | 701/21 |
| 8,150,569 | B2 * | 4/2012 | Kaji | 701/21 |
| 8,435,087 | B2 * | 5/2013 | Morvillo | 440/41 |

(Continued)

*Primary Examiner* — Russell Frejd

(74) *Attorney, Agent, or Firm* — Andrus Intellectual Property Law, LLP

(57) ABSTRACT

Methods and systems are for controlling movement of at least one propulsion unit on a marine vessel. The method comprises plotting a first plurality of points representing a first surface of a first propulsion unit and plotting a second plurality of points representing a second surface. The method further comprises limiting movement of at least the first propulsion unit such that the first surface does not come within a predetermined distance of the second surface during said movement.

25 Claims, 9 Drawing Sheets

(56) References Cited

U.S. PATENT DOCUMENTS 8,613,634 B2 * 12/2013 Morvillo ..... 440/40
8,631,753 B2 * 1/2014 Morvillo ..... 114/285
8,700,238 B2 * 4/2014 Hiramatsu ..... 701/21
2007/0017426 A1 * 1/2007 Kaji et al. ..... 114/144 RE
2008/0269968 A1 * 10/2008 Stewart ..... 701/21
2010/0297896 A1 * 11/2010 Duncan ..... 440/52

* cited by examiner

SYSTEMS AND METHODS FOR CONTROLLING MOVEMENT OF PROPULSION UNITS ON A MARINE VESSEL

FIELD

The present disclosure relates to systems and methods for controlling movement of propulsion units on a marine vessel. Specifically, the present disclosure relates to propulsion units that can be moved to various trim angles and/or steering angles.

BACKGROUND

U.S. Pat. No. 6,913,497 discloses a connection system for connecting two or more marine propulsion devices together. The connection system provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

U.S. Pat. No. 7,267,588 discloses a steering system for a marine vessel. The steering system is provided with a connecting link attached to first and second marine propulsion devices. The connecting link is selectively disposable in first and second states of operation which either require synchronous rotation of the first and second marine propulsion devices or, alternatively, independent rotation of the two marine propulsion devices. This allows both marine propulsion devices to be operated by a single actuator or, alternatively, independent maneuvering of the two marine propulsion devices during certain types of docking procedures.

U.S. Pat. No. 7,467,595 discloses a method for controlling the movement of a marine vessel. The method rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Disclosed are methods for controlling movement of at least one propulsion unit on a marine vessel. In some examples, the methods comprise plotting a first plurality of points representing a first surface of a first propulsion unit and plotting a second plurality of points representing a second surface. The methods can further comprise limiting movement of at least the first propulsion unit such that the first surface does not come within a predetermined distance of the second surface during said movement.

Also disclosed are control systems for controlling moment of at least one propulsion unit on a marine vessel. In some examples, the control systems comprise a control circuit configured to plot a first plurality of points representing a first surface of a first propulsion unit and to plot a second plurality of points representing a second surface. The control circuit can limit movement of at least the first propulsion unit such that the first surface does not come within a predetermined distance of the second surface during said movement.

Also disclosed are methods for controlling movement of at least one propulsion unit on a marine vessel. In some examples, the methods comprise limiting movement of at least a first propulsion unit and a second propulsion unit based on trim angles of the first and second propulsions units, steering angles of the first and second propulsion units, a drive separation distance between the first and second propulsion units, and dimensions of the first and second propulsion units.

BRIEF DESCRIPTION OF THE DRAWINGS

Examples of systems and methods for controlling movement of propulsion units on a marine vessel are described with reference to the following Figures. The same numbers are used throughout the Figures to reference like features and like components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC §112, sixth paragraph, only if the terms "means for" or "step for" are explicitly recited in the respective limitation.

Figure 1:
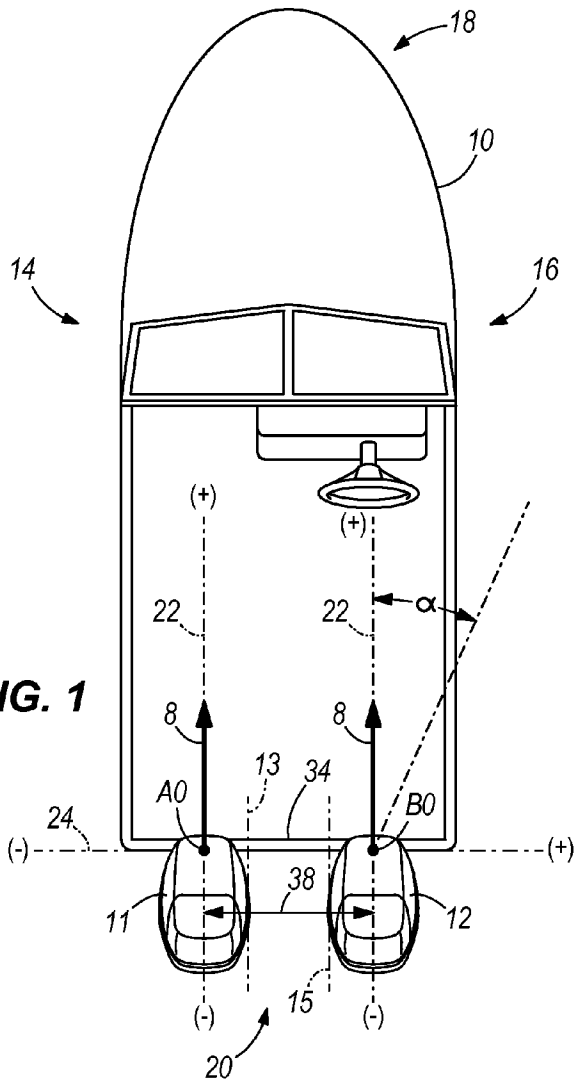

FIG. 1 depicts a marine vessel 10 having a least one propulsion unit. In the embodiment of FIG. 1, the marine vessel 10 comprises a first propulsion unit 11 and a second propulsion unit 12. In the embodiment shown, the first propulsion unit 11 is located on a port side 14 of the marine vessel 10 and the second propulsion unit 12 is located on a starboard side 16 of the marine vessel 10. The marine vessel 10 has a bow 18 and a stern 20. The propulsion units are not limited to the embodiments shown, but can be inboard drives, outboard drives, stern drives, or pod drives with propellers or jet drives powered by engines, motors, or hybrid drive systems.

Each of the propulsion units 11, 12 can be described in three dimensions, namely, each propulsion unit extends along an x-axis 22, a y-axis 24, and a z-axis 26 (shown in FIGS. 6-10). The x-axis 22 runs from the front to the back of each propulsion unit 11, 12. The y-axis 24 runs from the starboard side 16 to the port side 14 of each propulsion unit 11, 12. The z-axis 26 runs from the top to the bottom of each propulsion unit 11, 12. The propulsion units 11, 12 provide propulsive thrust to the marine vessel 10 in the direction of the arrows 8 shown. Either or both of the propulsion units 11, 12 can be rotated to a steering angle α. In FIG. 1, the steering angle α of each propulsion unit 11, 12 is zero degrees, i.e., both of the propulsion units 11, 12 are directly aligned with their respective x-axis 22.

Figure 2:
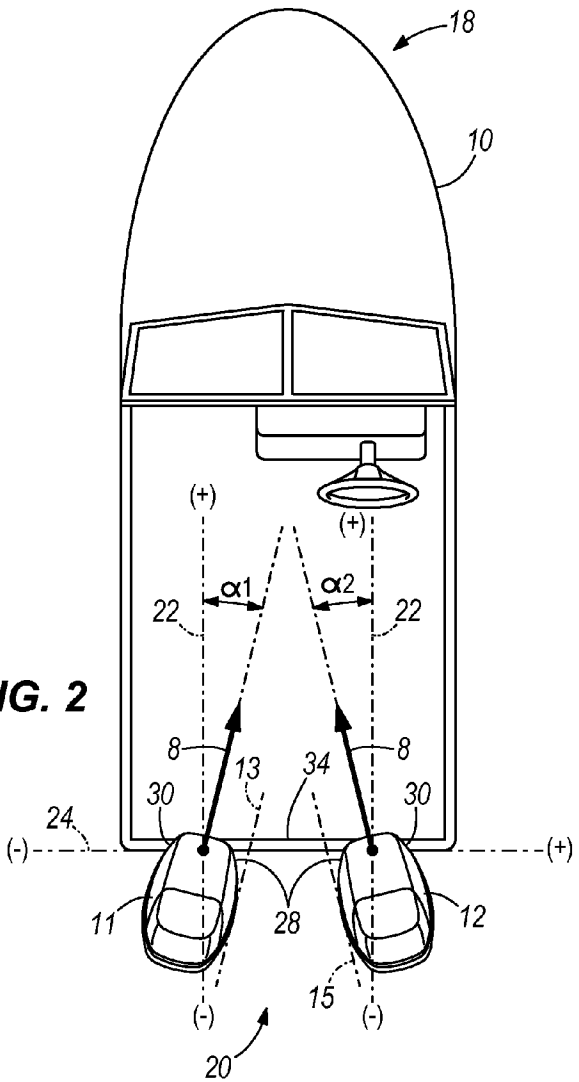
FIGS. 1-4 are schematic top views of a marine vessel with two propulsion units.

FIG. 2 shows the propulsion units 11, 12 in an alternate configuration. In FIG. 2, the first propulsion unit 11 is rotated with respect to the x-axis 22 by a steering angle α1. In the embodiment shown in FIG. 2, the steering angle α1 has a negative value, according to the convention of the x-, y-, and z-axes. The second propulsion unit 12 is also rotated at a steering angle α2 with respect to the x-axis 22; however, the steering angle α2 has a positive value.

Figure 3:
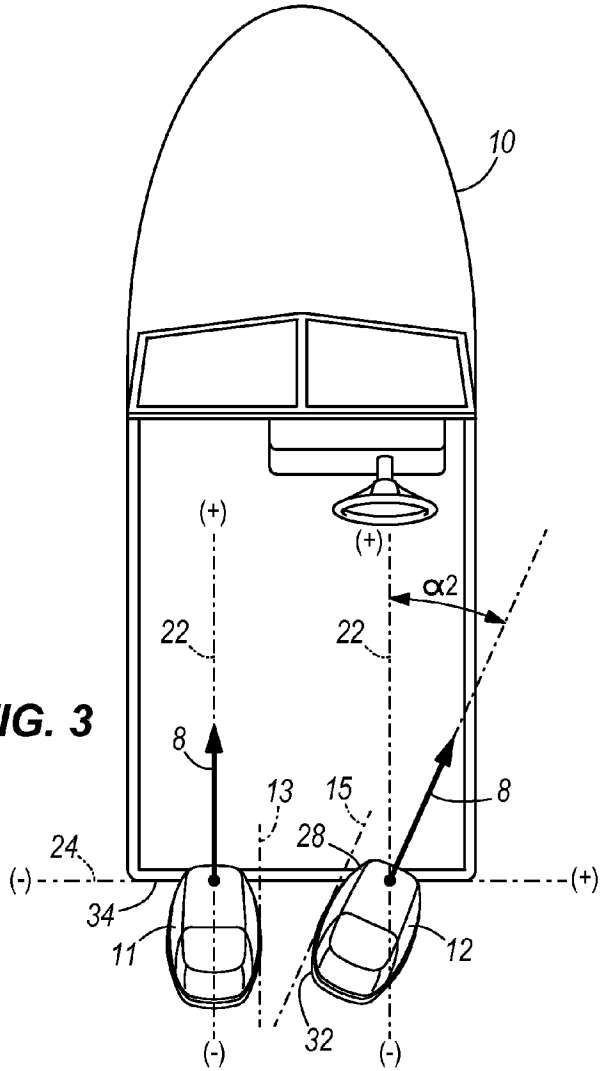

In the embodiment shown in FIG. 3, the first propulsion unit 11 has a steering angle α1 of zero degrees. The second propulsion unit 12 is rotated to a steering angle α2, and the steering angle α2 has a negative value.

Figure 4:
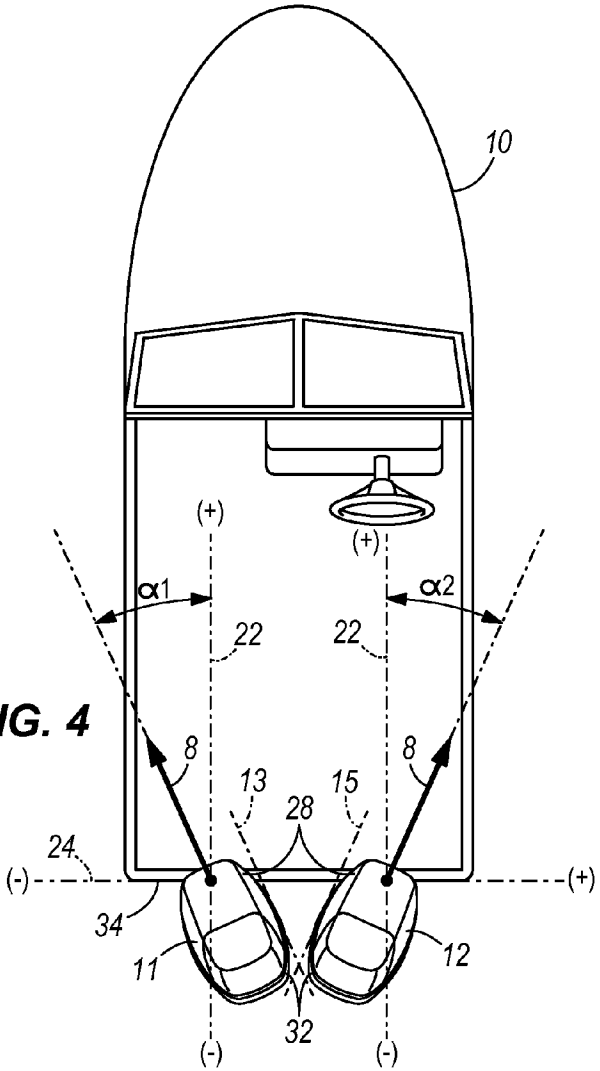

In the embodiment shown in FIG. 4, the first propulsion unit 11 is rotated to a positive steering angle α1. The second propulsion unit 12 is rotated to a negative steering angle α2. Therefore, it can be seen from FIGS. 1-4 that many alternative configurations of the first and second propulsion units 11, 12 are contemplated within the scope of the present disclosure.

Conventional design of the marine vessel 10 will ensure that the propulsion units 11, 12 of FIG. 1 do not interfere with one another during forward travel. However, due to the steering angles α1, α2 shown in the embodiment of FIG. 2, the inner front portions 28 of the first and second propulsion units 11, 12 could possibly interfere with one another. In other words, depending on the configuration of the marine vessel 10, the size and configuration of the propulsion units 11, 12, and the steering angles α1, α2 of the propulsion units 11, 12, it is possible that the inner front portions 28 would touch one another and damage the propulsion units 11, 12. It is also possible, depending on the configuration of the marine vessel 10, the size and configuration of the propulsion units 11, 12, and the steering angles α1, α2 of the propulsion units 11, 12, that the outer front portions 30 of the propulsion units 11, 12 may interfere with, or touch, the hull 34 at the stern 20 of the marine vessel 10, and possibly damage the marine vessel 10. As used herein, the term "portion" refers to any part of the propulsion units 11, 12, such as for example a propeller 48, or an engine cowling 64 (see FIG. 6).

In FIG. 3, not only is it possible that the inner front portion 28 of the second propulsion unit 12 may damage the vessel 10, it is also possible that that inner back portion 32 of the second propulsion unit 12 may damage the first propulsion unit 11. Alternatively, FIG. 4 depicts a situation in which the inner front portions 28 of both propulsion units 11, 12 could possibly damage the hull 34 of the marine vessel 10. Additionally, the inner back portions 32 of each propulsion unit 11, 12 could touch and possibly damage one another.

Figure 6:
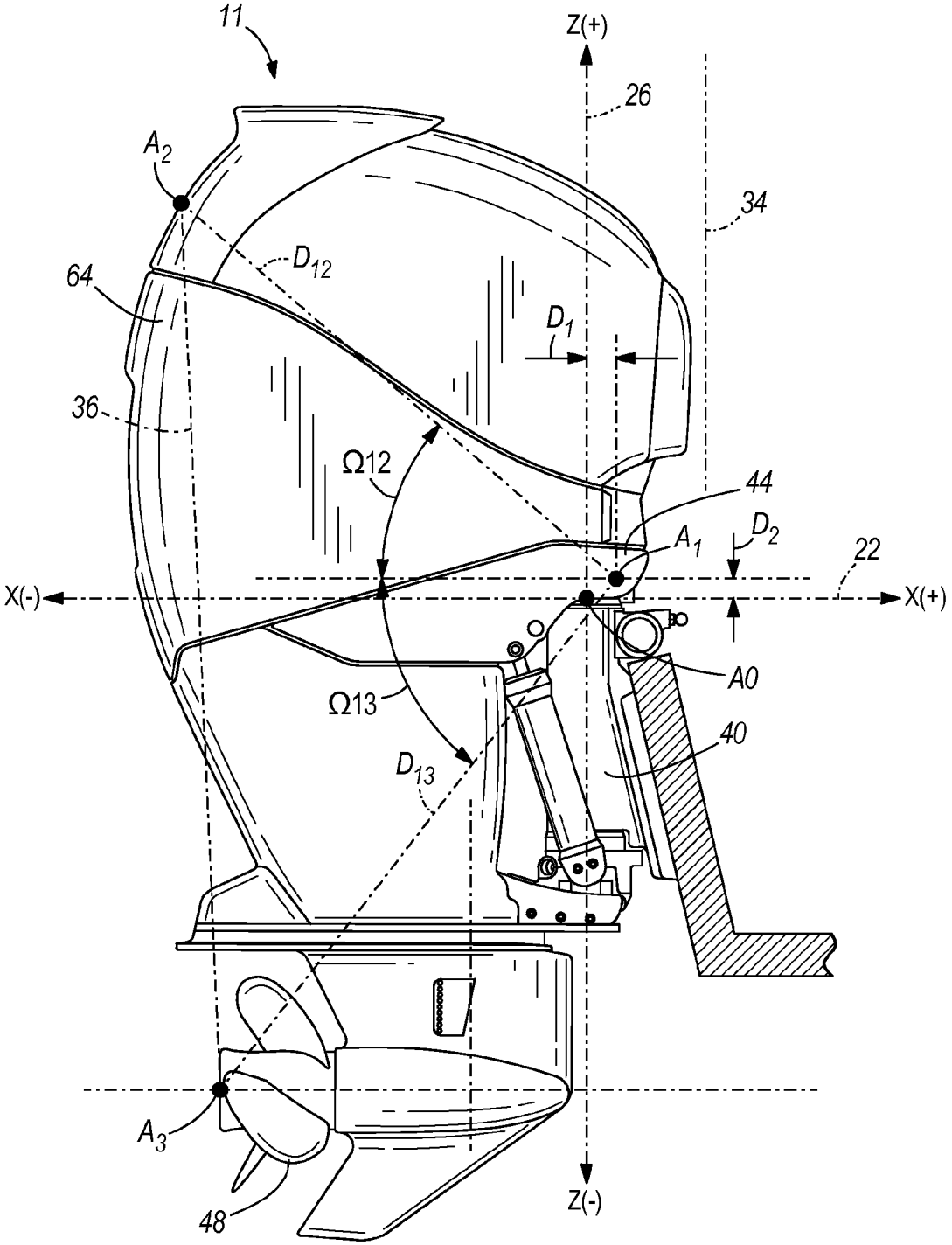
FIG. 6 is a side view of a first propulsion unit.
Figure 7:
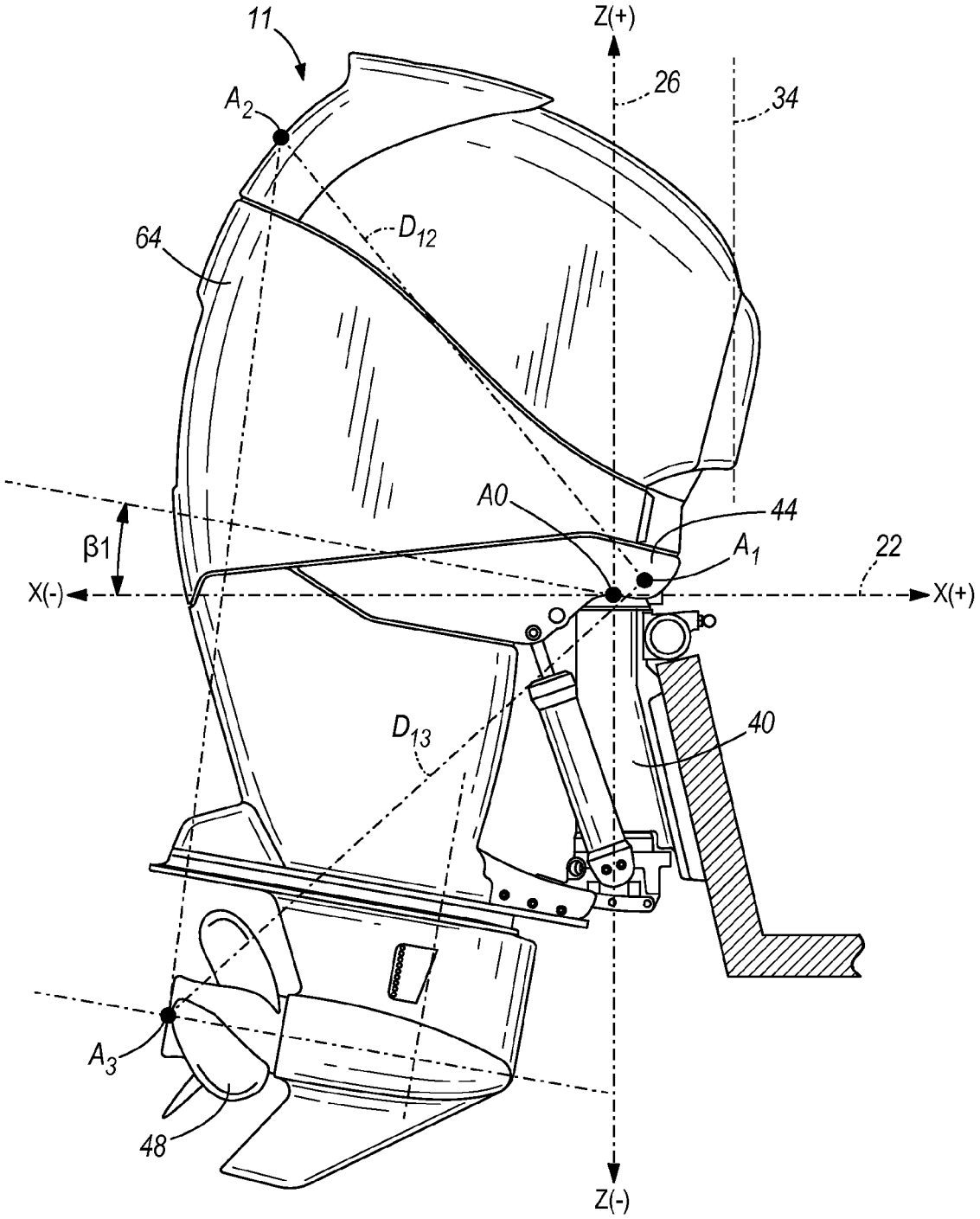
FIG. 7 is a view similar to FIG. 6, wherein the first propulsion unit has a different trim angle than the first propulsion unit of FIG. 6.

So far, interference between either of the propulsion units 11, 12 and the marine vessel 10, or between the propulsion units 11, 12 with one another, has been described with respect to the steering angles α1, α2 of the propulsion units 11, 12. However, the tilt angles of the propulsion units 11, 12 may also have an effect on the interference between these components 10, 11, 12. FIGS. 6 and 7 illustrate what is meant by a "trim angle" of the propulsion units 11, 12. In FIG. 6, the trim angle of the propulsion unit 11 is zero degrees; in other words, the propulsion unit 11 is not rotated with respect to the x-y plane. In contrast, the trim angle of the propulsion unit 11 in FIG. 7 is a positive value β1. Although not shown in the Figs., the second propulsion unit 12 may also be rotated to a trim angle β2. The trim angles β1, β2 are measured with respect to the x-y plane. From FIGS. 6 and 7, it can be seen that the trim angle β1 of the propulsion unit 11 could cause the propulsion unit 11 to interfere with the hull 34 at the stern 20 of the marine vessel 10.

Figure 5:
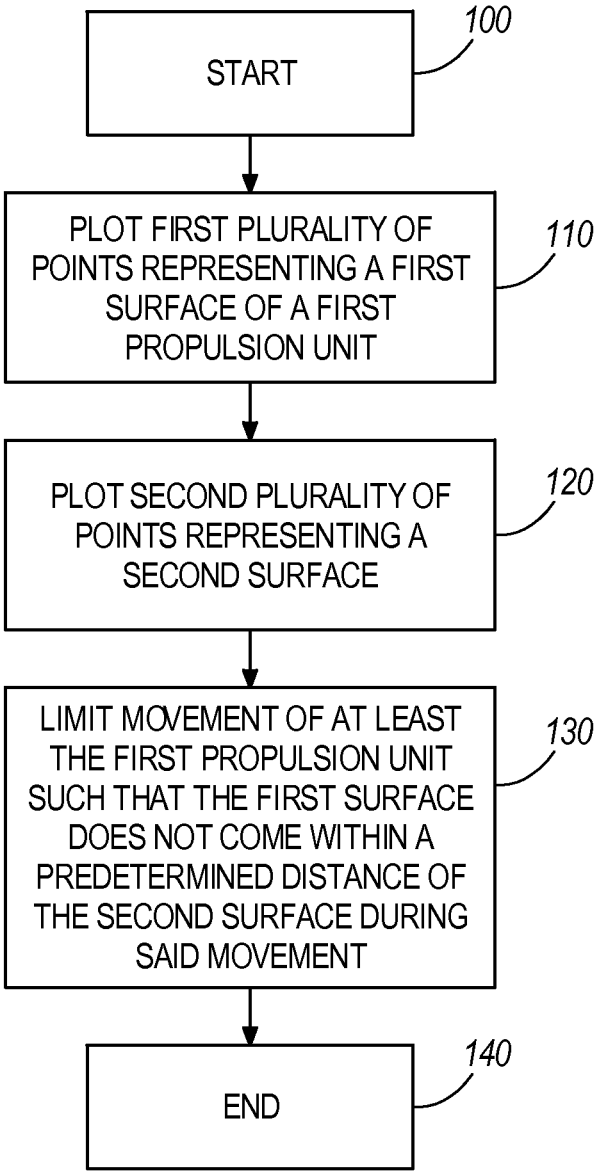
FIG. 5 is a flowchart depicting a method for controlling movement of propulsion units on a marine vessel.

Now with reference to FIG. 5, a method for controlling movement of at least one propulsion unit 11, 12 on a marine vessel 10 will be described. The method begins at 100. The method comprises plotting a first plurality of points representing a first surface of a first propulsion unit, as shown at 110. The method further comprises plotting a second plurality of points representing a second surface, as shown at 120. The method further comprises limiting movement of at least the first propulsion unit such that the first surface does not come within a predetermined distance of the second surface during said movement, as shown at 130. The method ends at 140.

Now with reference to FIGS. 6-10, another example of a method for controlling movement of at least one propulsion unit 11, 12 on a marine vessel 10 will be described in more detail. The method comprises plotting a first plurality of points representing a first surface of a first propulsion unit 11. In the example shown in FIG. 6, the first plurality of points comprises three points A1, A2, and A3. The points A1, A2, and A3 in the first plurality of points represent a first surface, such as a plane 13 (see FIGS. 1-4) along the starboard side 16 of the first propulsion unit 11. In an alternative embodiment, the first surface is a triangle connecting the three points A1, A2, and A3, such as triangle 36. In an alternative embodiment, more than three points are chosen for the first plurality of points. The number of points in the first plurality of points chosen to represent the first surface of the first propulsion unit 11 depends on configuration of the marine vessel 10 and the propulsion units 11, 12, as well as any preference regarding the level of detail used to model the first surface of the first propulsion unit 11.

In one example, each of the points in the first plurality of points can be chosen such that one of the points in the first plurality of points does not change as a function of one of the steering angle α1 and trim angle β1 of the first propulsion unit 11. For example, in FIG. 6, point A1 is on an axis 42 (shown in FIG. 10) of a trim pivot tube 44 of the first propulsion unit 11. In other words, the coordinates of point A1 do not change when the trim angle β1 of the first propulsion unit 11 changes, but rather the coordinates of point A1 remain fixed with respect to the trim angle β1 of the first propulsion unit 11 due to the fact that point A1 is on the axis 42 of the trim pivot tube 44. Regarding the remainder of points in the first plurality of points, the point A2 is proximate an upper half of the first propulsion unit 11. The point A3 is proximate a lower half of the first propulsion unit 11. Points A2 and A3, and any other points plotted in the first plurality of points, may be chosen at extremities of the first propulsion unit 11 in order to approximate the areas of the first propulsion unit 11 that are likely to interfere with the marine vessel 10 and/or the second propulsion unit 12.

Figure 9:
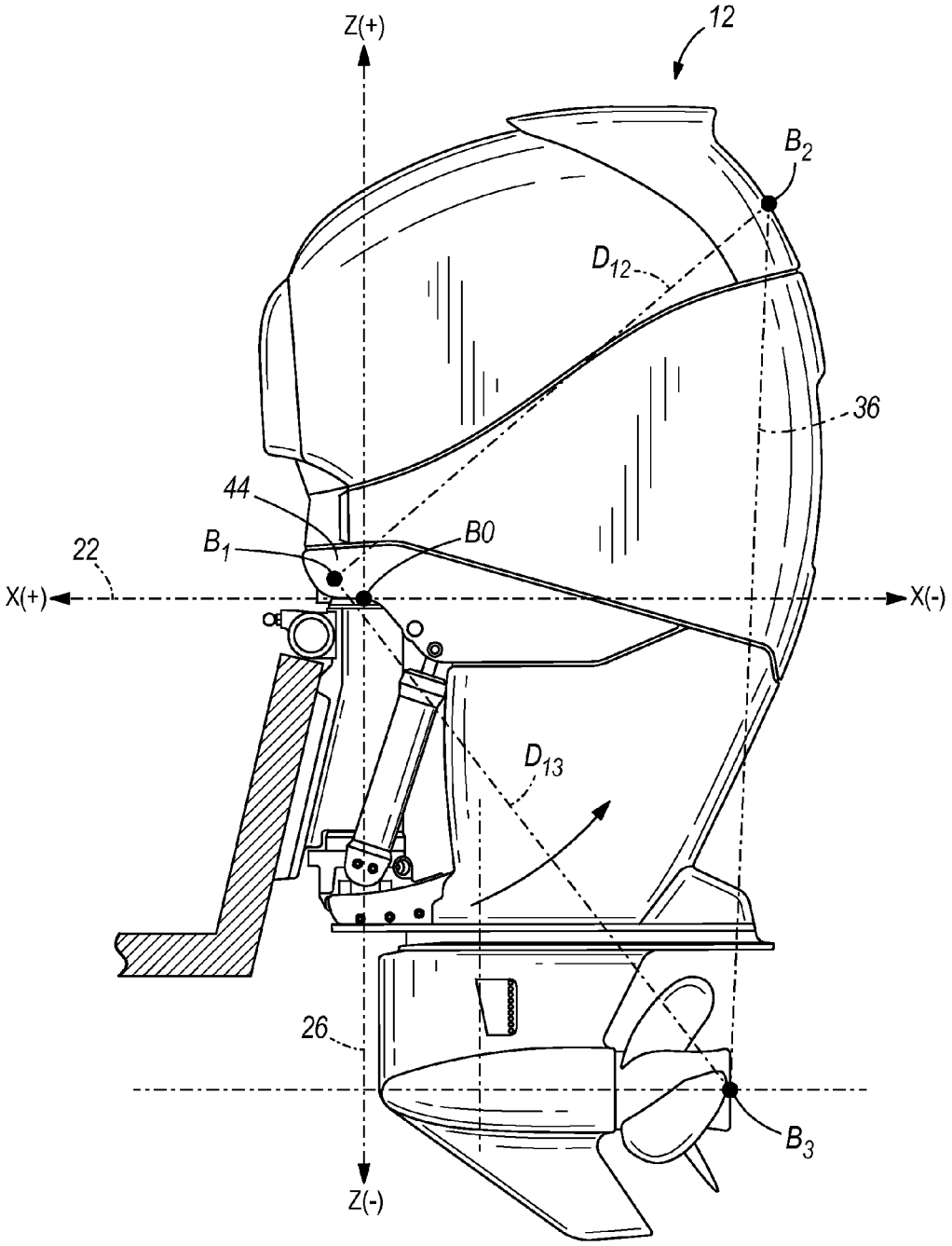
FIG. 9 is a side view of a second propulsion unit.

According to the non-limiting exemplary method, a second plurality of points is plotted to represent a second surface. In one embodiment, the second surface is the surface of the hull 34, for example, at the stern 20 of the marine vessel 10. In another embodiment, the second surface is a surface of the second propulsion unit 12. In the latter case, the second plurality of points comprises three points B1, B2, and B3. As shown in FIG. 9, the points B1, B2, and B3 have positions corresponding to the positions of points A1, A2, and A3 on the first propulsion unit 11, but are located on the port side 14 of the second propulsion unit 12. The point B1 is on an axis 42 of the trim pivot tube 44 of the second propulsion unit 12. The point B2 is proximate an upper half of the second propulsion unit 12. The point B3 is proximate a lower half of the second propulsion unit 12. The points B1, B2, B3 on the second propulsion unit 12 represent a second surface, which can be, for example, a plane 15 along the port side 14 of the second propulsion unit 12 (see FIGS. 1-4). In another embodiment, the second surface comprises a triangle 36 connecting the points B1, B2, and B3. As shown in FIG. 1, when both the trim angles β1, β2 and steering angles α1, α2 of the first and the second propulsion units 11, 12 are zero, the second plane 15 is parallel to the first plane 13.

Once both the first and second pluralities of points have been plotted to represent the first and second surfaces respectively, distances between the first propulsion unit 11 and the second surface can be calculated. In one example, once both the first and second pluralities of points have been plotted to represent the first and second surfaces of the first and second propulsion units 11, 12 respectively, distances between the propulsion units 11, 12 can be calculated. With reference to FIGS. 1-10, the presently disclosed method comprises calculating the distance between each of the points A1, A2, A3 in the first plurality of points to the second plane 15 and calculating the distance between each of the points B1, B2, B3 in the second plurality of points to the first plane 13. These distances can be calculated as a function of requested trim angles β1, β2 and steering angles α1, α2 of the first and second propulsion units 11, 12. In other words, the distances can be calculated in real time as a user requests a certain trim angle β or steering angle α for either one or both of the propulsion units 11, 12. If the calculations show that the distance between any of the points in the first plurality of points and the second plane 15 or the distance between any of the points in the second plurality of points and the first plane 13 is within a predetermined threshold, then the method can limit movement of at least the first propulsion unit 11. In other words, the method limits movement of at least the first propulsion unit 11 such that the first surface does not come within a predetermined distance of the second surface. In alternative embodiments, the method limits movement of the second propulsion unit 12 or both the first and second propulsion units 11, 12.

In one embodiment, the method limits movement of the propulsion units 11, 12 so that they do not touch. In this embodiment, the method includes limiting movement of at least one of the first and second propulsion units 11, 12 when a distance between any one of the points A1, A2, A3 in the first plurality of points and the second plane 15 has a sign that is different than the signs of the distances between any of the remaining points A1, A2, A3 in the first plurality of points and the second plane 15. For instance, if the distance between the point A1 and the second plane 15 has a sign that is positive, the distance between the point A2 and the second plane 15 has a sign that is negative, and the distance between the point A3 and the second plane 15 has a sign that is negative, then the sign of the distance between the point A1 and the second plane 15 is different than the sign of the distances between the remaining points A2, A3 and the second plane 15, and the method would limit movement of the first and/or second propulsion units 11, 12. The method also would limit movement of at least one of the first and second propulsion units 11, 12 when a distance between any one of the points B1, B2, B3 in the second plurality of points and the first plane 13 has a sign that is different than the signs of the distances between any of the remaining points B1, B2, B3 in the second plurality of points and the first plane 13.

In another embodiment, the method limits movement of the propulsion units 11, 12 so that they do not come within a predetermined distance of one another. In this embodiment, the method limits movement of at least one of the first and second propulsion units 11, 12 when the absolute value of the distance between any one of the points A1, A2, A3 in the first plurality of points and the second plane 15 is less than a predetermined threshold. For example, if the predetermined threshold is three inches, and the point A1 is two inches from the second plane 15, the point A2 is four inches from the second plane 15, and the point A3 is eight inches from the second plane 15, the method would limit movement of one of the first and second propulsion units 11, 12 because the first point A1 was within the predetermined threshold distance of the second plane 15. The method may also comprise limiting movement of at least one of the first and second propulsion units 11, 12 when the absolute value of the distance between any one of the points B1, B2, B3 in the second plurality of points and the first plane 13 is less than the predetermined threshold. Setting a predetermined threshold ensures that there is no contact between any point in the first or second plurality of points and the second or first surface, respectively, by providing for room for error in measurement of vessel and propulsion unit geometry, plotting of points, software and data update rates, and distance calculations.

With further reference to FIGS. 6-10, a specific example of the above methods will be described in more detail. The following example calculations are not the only way to model the first surface of the first propulsion unit, model the second surface, and limit movement of at least the first propulsion unit such that that first surface does not come within a predetermined distance of the second surface during said movement. Rather, the following calculations are included to further enable one having ordinary skill in the art to practice the present disclosure. In the following exemplary method, the following terms have the following meanings: the steering angle α is the angle of a propulsion unit 11, 12 relative to the x-axis 22 of that respective propulsion unit 11, 12; the trim angle β is the angle of a propulsion unit 11, 12 relative to horizontal, in other words, relative to the x-y plane.

Figure 10:
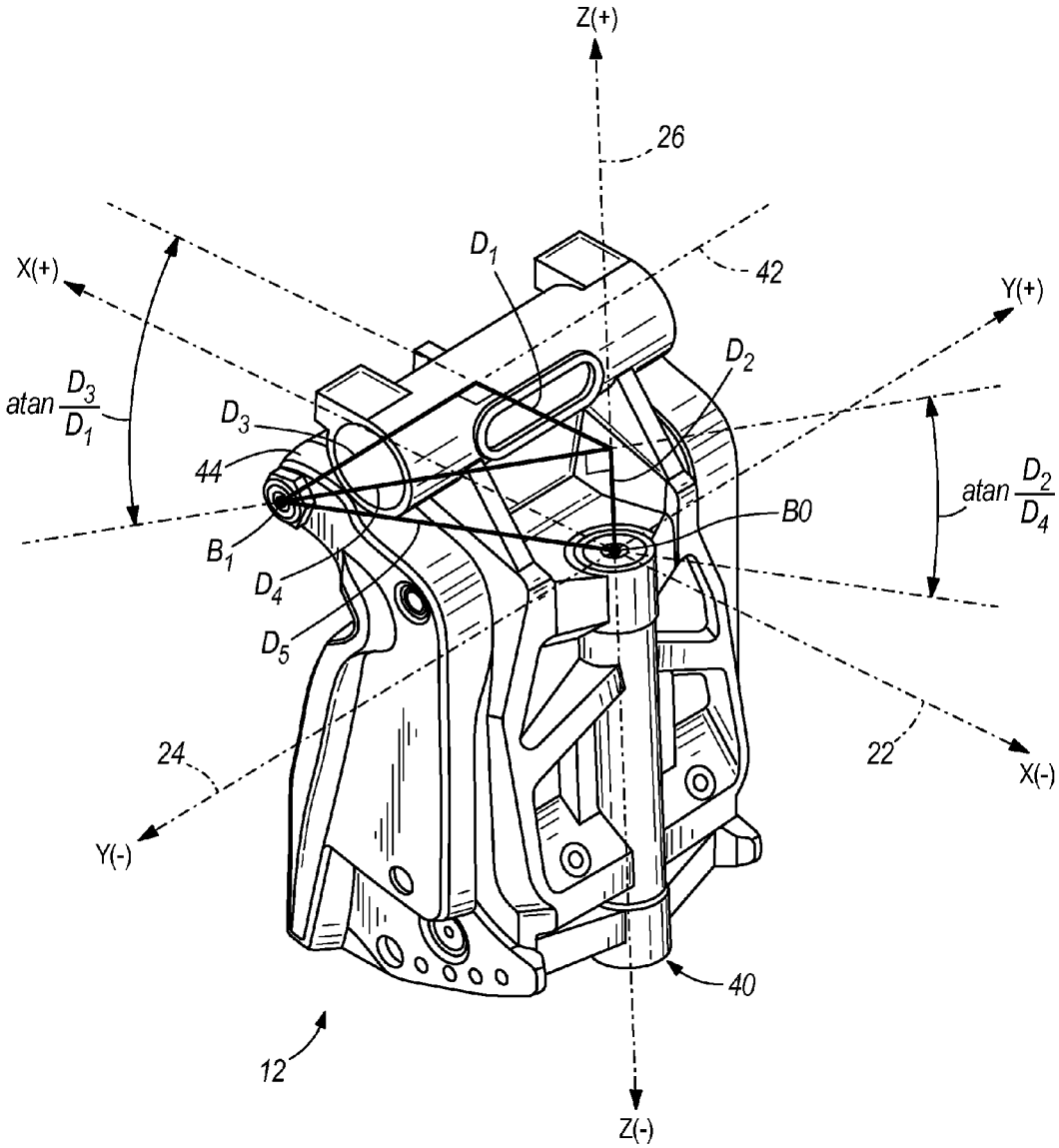
FIG. 10 is a perspective, cut-away view of the second propulsion unit.

According to an exemplary method, a first plurality of points is plotted to represent a first surface of a first propulsion unit 11. As shown in FIGS. 6-7, point A1 is on the axis 42 of the trim pivot tube 44 of the first propulsion unit 11. A three-dimensional coordinate system is set up with an origin AO located at the top of a steering pivot 40 where an advanced mid-section (not shown) of the propulsion unit 11 swivels on the steering pivot 40. A similar origin BO defines the coordinate system of the second propulsion unit 12, as shown in FIGS. 9-10. The origin BO on the second propulsion unit 12 is offset from the origin AO of the first propulsion unit 11 by a drive separation distance 38, as shown in FIG. 1, as will be further described hereinbelow. Each of the x-axis 22, y-axis 24 and z-axis 26 for each propulsion unit 11, 12 runs through the origins AO, BO in the directions described above.

In order to simplify the calculations for the method, several inputs are needed. These inputs are determined by measuring physical aspects of the propulsion devices 11, 12 themselves, and may vary depending on the given propulsion device. The inputs are shown in FIGS. 1-10. For purposes of simplifying the exemplary method, it is assumed that the propulsion units 11, 12 are identical. Therefore, each of the values, D1, D2, D3, D12, D13, Ω12, Ψ12, Ω13, and Ψ13 described below are assumed to be the same and will be defined only with respect to the first propulsion unit 11, although in other methods these values could be different for each propulsion unit 11, 12. In contrast, the trim angles β1, β2 and steering angles α1, α2 are not necessarily assumed to be the same for each propulsion unit 11, 12, and will also vary in real time according to operator requests.

$\alpha 1$, $\alpha 2$ the steering angles of the first and second propulsion units 11, 12 (FIGS. 1-4).

$\beta 1$, $\beta 2$ the trim angles of the first and second propulsion units 11, 12 (FIGS. 6-7).

D1, the distance in the x-direction from the steering pivot axis (which is also the z-axis 26) to the trim pivot axis 42, which runs parallel to the y-axis through point A1 (FIGS. 6 & 10).

D2, the height in the z-direction of the trim pivot tube 44 (at point A1) from the top of the steering pivot 40 (which lies on the x-y plane) (FIGS. 6 & 10).

D3, half the length of the trim pivot tube 44 (FIG. 10).

D12, the length of the line connecting point A1 to point A2 (FIG. 6).

D13, the length of the line connecting point A1 to point A3 (FIG. 6).

$\Omega 12$, the angle between point A1 and point A2 in a plane parallel to the x-z plane when the propulsion device 11 has a trim angle $\beta 1$ of zero (FIG. 6). This can be referred to as the "trim angle offset", which will be added to the operator requested trim angle $\beta 1$ in the calculations shown below.

Figure 8:
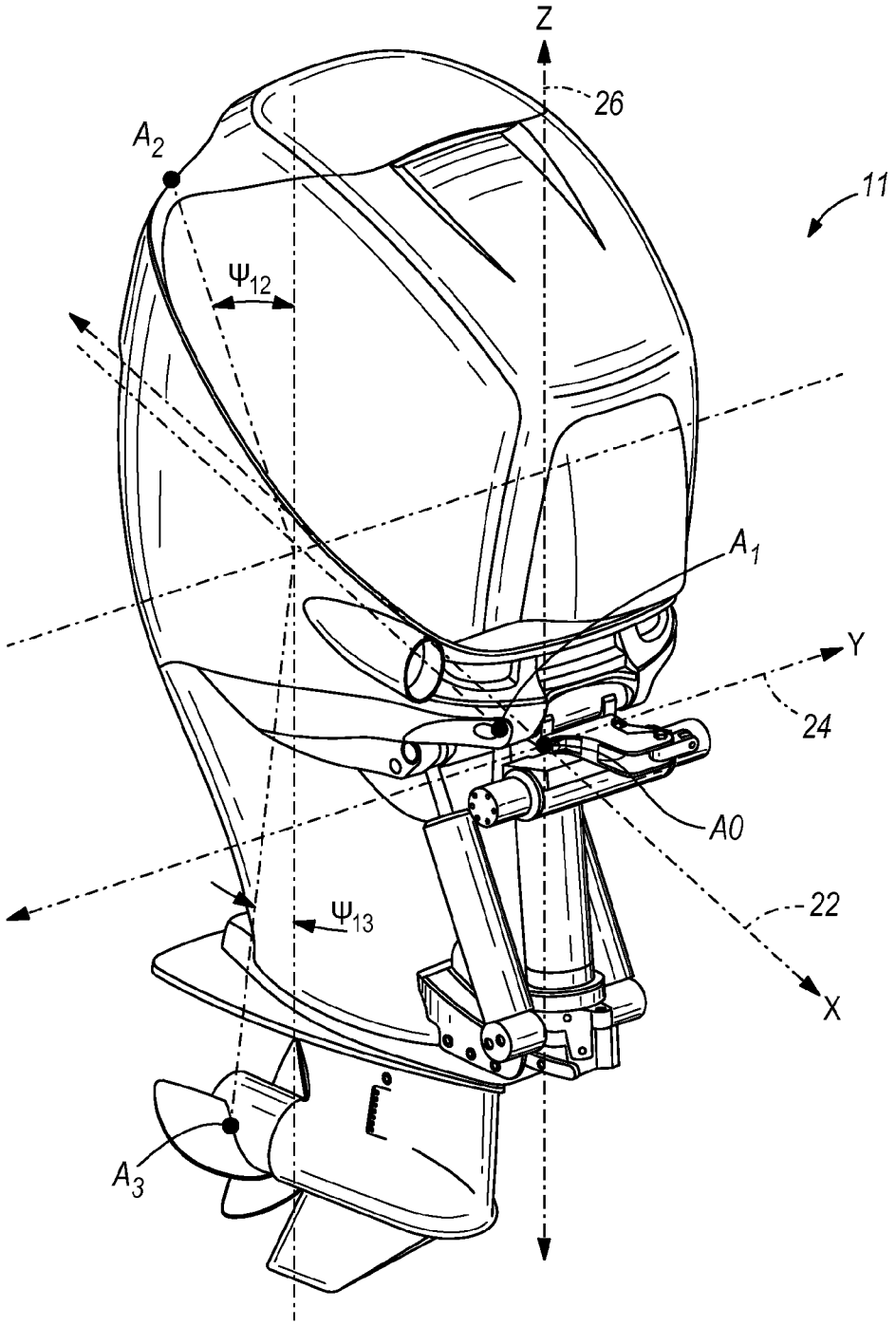
FIG. 8 is a perspective view of the first propulsion unit.

$\Psi 12$, the angle between point A1 and A2 in a plane parallel to the y-z plane when the propulsion device 11 has a steering angle $\alpha 1$ of zero (FIG. 8). This can be referred to as the "steering angle offset", which will be added to the operator requested steering angle $\alpha 1$ in the calculations shown below.

$\Omega 13$, the angle between point A1 and point A3 in a plane parallel to the x-z plane when the propulsion device 11 has a trim angle $\beta 1$ of zero (FIG. 6). This can be referred to as the "trim angle offset", which will be added to the operator requested trim angle $\beta 1$ in the calculations shown below.

$\Psi 13$, the angle between point A1 and A3 in a plane parallel to the y-z plane when the propulsion device 11 has a steering angle $\alpha 1$ of zero (FIG. 8). This can be referred to as the "steering angle offset", which will be added to the operator requested steering angle $\alpha 1$ in the calculations shown below.

From these values, we can determine several other values:

$$D4=\text{sqrt}(D1^2+D3^2). \text{ (FIG. 10)}$$

$$D5=\text{sqrt}(D4^2+D2^2). \text{ (FIG. 10)}$$

The points A1, A2 and A3 are then described in spherical coordinates with respect to the x-, y-, and z-axes. The spherical coordinates for point A1 are defined as ($\theta_{AOA1}$, $\Phi_{AOA1}$, $\rho_{AOA1}$), where $\theta_{AOA1}$ is the angle from the origin AO to a projection of point A1 onto the x-y plane with respect to the x-axis 22, $\Phi_{AOA1}$ is the angle from the origin AO to point A1 with respect to the x-y plane, and $\rho_{AOA1}$ is the distance from the origin AO to point A1.

$$\theta_{AOA1}=\alpha 1+a\tan(D3\div D1). \text{ (FIG. 10)}$$

$$\Phi_{AOA1}=a\tan(D2\div D4). \text{ (FIG. 10)}$$

$$\rho_{AOA1}=D5=\text{sqrt}(D4^2+D2^2). \text{ (FIG. 10)}$$

The spherical coordinates for point A1 ($\theta_{AOA1}$, $\Phi_{AOA1}$, $\rho_{AOA1}$) are then converted to Cartesian coordinates ($X_{A1}$, $Y_{A1}$, $Z_{A1}$). This can be done with a computer program (hereinafter "sph2cart") using the following equations:

$$X_{A1}=\rho_{AOA1}*\cos(\Phi_{AOA1})*\cos(\theta_{AOA1}).$$

$$Y_{A1}=\rho_{AOA1}*\cos(\Omega_{AOA1})*\sin(\omega_{AOA1}).$$

$$Z_{A1}=\rho_{AOA1}*\sin(\Phi_{AOA1}).$$

Next, using point A1 as a new origin, the spherical coordinates for points A2 are calculated. Given the values D1, D2, D3, D12, D13, $\Psi 12$, $\Omega 12$, D4, and D5:

$$(\theta_{A1A2},\Phi_{A1A2},\rho_{A1A2})=(\alpha 1+\Psi 12,\beta 1+\Omega 12,D12).$$

Then, ($X_{A2}$, $Y_{A2}$, $Z_{A2}$)=($X_{A1}$, $Y_{A1}$, $Z_{A1}$)+sph2cart($\alpha 1+\Psi 12$, $\beta 1+\Omega 12$, D12).

Next, using point A1 as the new origin, the spherical coordinates for points A3 are determined. Given the values D1, D2, D3, D12, D13, $\Psi 13$, $\Omega 13$, D4, and D5:

$$(\theta_{A1A3},\Phi_{A1A3},\rho_{A1A3})=(\alpha 1+\Psi 13,\beta 1+\Omega 13,D13).$$

Then, ($X_{A3}$, $Y_{A3}$, $Z_{A3}$)=($X_{A1}$, $Y_{A1}$, $Z_{A1}$)+sph2cart($\alpha 1+\Psi 13$, $\beta 1+\Omega 13$, D13).

Next a plurality of points is plotted representing a second surface, namely a plane on the port side 14 of the second propulsion unit 12, as shown in FIG. 1. The location of point B1 on the second propulsion unit 12 is calculated from the origin BO of the second propulsion unit 12, which, as mentioned above, is offset from the origin AO of the first propulsion unit 11 by the drive separation distance 38. D1, D2, D3, D4, D5, D12, D13, $\Psi 12$, $\Omega 12$, $\Psi 13$, and $\Omega 13$ are all defined as above for the first propulsion unit 11. Here however, the second propulsion unit 12 may have a different steering angle $\alpha 2$ then the steering angle $\alpha 1$ of the first propulsion unit 11. Alternatively, the steering angles of the first and second propulsion units 11, 12 could be the same. In any case, $$\theta_{BOB1}=\alpha 2+a\tan(D3\div D1). \text{ (FIG. 10)}$$

$$\Phi_{BOB1}=a\tan(D2\div D4). \text{ (FIG. 10)}$$

$$\rho_{BOB1}=D5=\text{sqrt}(D4^2+D2^2). \text{ (FIG. 10)}$$

The spherical coordinates for point B1 ($\theta_{BOB1}$, $\Phi_{BOB1}$, $\rho_{BOB1}$) are then converted to Cartesian coordinates ($X_{B1}$, $Y_{B1}$, $Z_{B1}$). Because the origin BO of the second propulsion unit 12 was defined with respect to the origin AO of the first propulsion unit 11, the y-coordinate of point B1 has the drive separation distance (reference number 38 in FIG. 1) added to it.

$$X_{B1}=\rho_{BOB1}*\cos(\Phi_{BOB1})*\cos(\theta_{BOB1}).$$

$$Y_{B1}=\rho_{BOB1}*\cos(\Phi_{BOB1})*\sin(\omega_{BOB1})+\text{drive separation distance 38}.$$

$$Z_{B1}=\rho_{BOB1}*\sin(\Phi_{BOB1}).$$

Next, using point B1 as a new origin, the spherical coordinates for point B2 are determined. Given the values D1, D2, D3, D12, D13, $\Psi 12$, $\Omega 12$, D4, and D5:

$$(\theta_{B1B2},\Phi_{B1B2},\rho_{B1B2})=(\alpha 2+\Psi 12,\beta 2+\Omega 12,D12).$$

Then, ($X_{B2}$, $Y_{B2}$, $Z_{B2}$)=($X_{B1}$, $Y_{B1}$, $Z_{B1}$)+sph2cart($\alpha 2+\Psi 12$, $\beta 2+\Omega 12$, D12).

Next, using point B1 as the new origin, the spherical coordinates for point B3 are determined. Given the values D1, D2, D3, D12, D13, $\Psi 13$, $\Omega 13$, D4, and D5:

$$(\theta_{B1B3},\Phi_{B1B3},\rho_{B1B3})=(\alpha 2+\Psi 13,\beta 2+\Omega 13,D13).$$

Then, ($X_{B3}$, $Y_{B3}$, $Z_{B3}$)=($X_{B1}$, $Y_{B1}$, $Z_{B1}$)+sph2cart($\alpha 2+\Psi 13$, $\beta 2+\Omega 13$, D13).

Thus, the (X, Y, Z) coordinates for each of A1, A2, A3, B1, B2, and B3 are defined with respect to the origin AO on the first propulsion unit 11. Next, surfaces representing both the first and second propulsion units 11, 12 are calculated. Namely, the first surface comprises a first plane 13 along a side of the first propulsion unit 11 that is adjacent the second propulsion unit 12. The second surface comprises a second plane 15 along a side of the second propulsion unit 12 that is adjacent the first propulsion unit 11. To calculate these planes 13, 15, the vector from point A1 to point A2 is first calculated. This is done according to subtraction of the matrix defining point A1 from the matrix defining point A2.

$V_{A1A2}=(X_{A2}, Y_{A2}, Z_{A2})-(X_{A1}, Y_{A1}, Z_{A1})$, where $(X_{A2}, Y_{A2}, Z_{A2})$ and $(X_{A1}, Y_{A1}, Z_{A1})$ are solved for hereinabove.

Next the vector from point A1 to point A3 is calculated.

$$V_{A1A3}=(X_{A3}, Y_{A3}, Z_{A3})-(X_{A1}, Y_{A1}, Z_{A1}).$$

Next the vector that is normal to $V_{A1A2}$ and $V_{A1A3}$ is calculated. This is done by taking the cross product between these two vectors.

$$V_{NA}=(X_{VNA}, Y_{VNA}, Z_{VNA})=(V_{A1A2}XV_{A1A3}).$$

The equation for the plane PA containing the points A1, A2, A3 is then:

$$X_{VNA}*(x\times X_{A1})+Y_{VNA}*(y-Y_{A1})+Z_{VNA}*(z-Z_{A1})=0.$$

Or, in vector form:

$V_{NA}*[x\ y\ z]^T+d1=0$, where d1 is the distance from the origin AO to the plane PA.

Next, the plane PB that contains the three points B1, B2, B3 is calculated. This is done according to the same vector calculations to achieve a similar equation for a plane PB:

$$V_{B1B2}=(X_{B2}, Y_{B2}, Z_{B2})-(X_{B1}, Y_{B1}, Z_{B1}).$$

$$V_{B1B3}=(X_{B3}, Y_{B3}, Z_{B3})-(X_{B1}, Y_{B1}, Z_{B1}).$$

$$V_{NB}=(X_{VNB}, Y_{VNB}, Z_{VNB})=(V_{B1B2}XV_{B1B3}).$$

The equation for the plane PB containing the points B1, B2, B3 is then:

$$X_{VNB}*(x-X_{B1})+Y_{VNB}*(y-Y_{B1})+Z_{VNB}*(z-Z_{B1})=0.$$

Or, in vector form:

$V_{NB}*[x\ y\ z]^T+d2=0$, where d2 is the distance from the origin BO to the plane PB.

Next, the distances between each of the points A1, A2, A3 in the first plurality of points and the second surface are calculated. These calculations are made using the equation for plane PB calculated above. Specifically, the distance from a point $P_0$ to a plane $\pi$ can be calculated by the below equation using a dot product:

$d(P_0, \pi)=n\bullet(P_0-V_0)$, where n is a vector normal to the plane $\pi$, $P_0$ is the point in question, and $V_0$ is a point on the plane $\pi$.

In other words, the distance from plane PB to point $A1=V_{NB}*A1+d2$.

$$\text{Distance from plane } PB \text{ to point } A2=V_{NB}*A2+d2.$$

$$\text{Distance from plane } PB \text{ to point } A3=V_{NB}*A3+d2.$$

Next, the distances between the points B1, B2, B3 in the second plurality of points and the first surface are calculated. These calculations are made using the equation for plane PA calculated above.

$$\text{Distance from plane } PA \text{ to point } B1=V_{NA}*B1+d1.$$

$$\text{Distance from plane } PA \text{ to point } B2=V_{NA}*B2+d1.$$

$$\text{Distance from plane } PA \text{ to point } B3=V_{NA}*B3+d1.$$

Next, the number of sign changes in the distance measurements calculated above is determined. If there is at least one sign change in the distances calculated above from the points A1, A2, A3 to plane PB and at least one sign change in the distances calculated above between points B1, B2, B3 and plane PA, then the method continues by limiting movement of at least the first propulsion unit 11 and possibly the second propulsion unit 12. The method limits movement of at least one of the first and second propulsion units 11, 12 because a sign change in the distance measurements indicates that at least one of the three points A1, A2, A3 has crossed plane PB and that at least one of the points B1, B2, B3 has crossed plane PA, simulating a touching of the first and second propulsion units 11, 12.

In an alternative embodiment, the movement of at least the first propulsion unit 11, and possibly the second propulsion unit 12, is limited when the first surface comes within a predetermined distance of the second surface. For example, if it is calculated that the distance between any of the points A1, A2, A3 and plane PB is less than or equal to for example, three inches, then the movement of at least one of the propulsion units 11, 12 is limited. Similarly, if it is calculated that the distance between any of the points B1, B2, B3 and the plane PA is less than or equal to for example, three inches, then movement of at least one of the propulsion units 11, 12 is limited. The predetermined threshold of three inches between the two propulsion units 11, 12 is merely exemplary and may be changed to accommodate any specified predetermined threshold distance.

Now with reference to FIG. 11, the methods described hereinabove can be carried out by a control system for controlling movement of at least one propulsion unit 11, 12 on a marine vessel 10. The control system comprises a control circuit 50 configured to plot a first plurality of points representing a first surface of a first propulsion unit 11 and to plot a second plurality of points representing a second surface. The control circuit 50 limits movement of at least the first propulsion unit 11 such that the first surface does not come within a predetermined distance of the second surface during said movement. The control circuit 50 includes a central processing unit (CPU) 52, ROM 54, RAM 56, an input/output (I/O) interface 58, and a computer-readable medium having computer-executable instructions for performing the above-noted method, including the steps set forth above.

Figure 11:
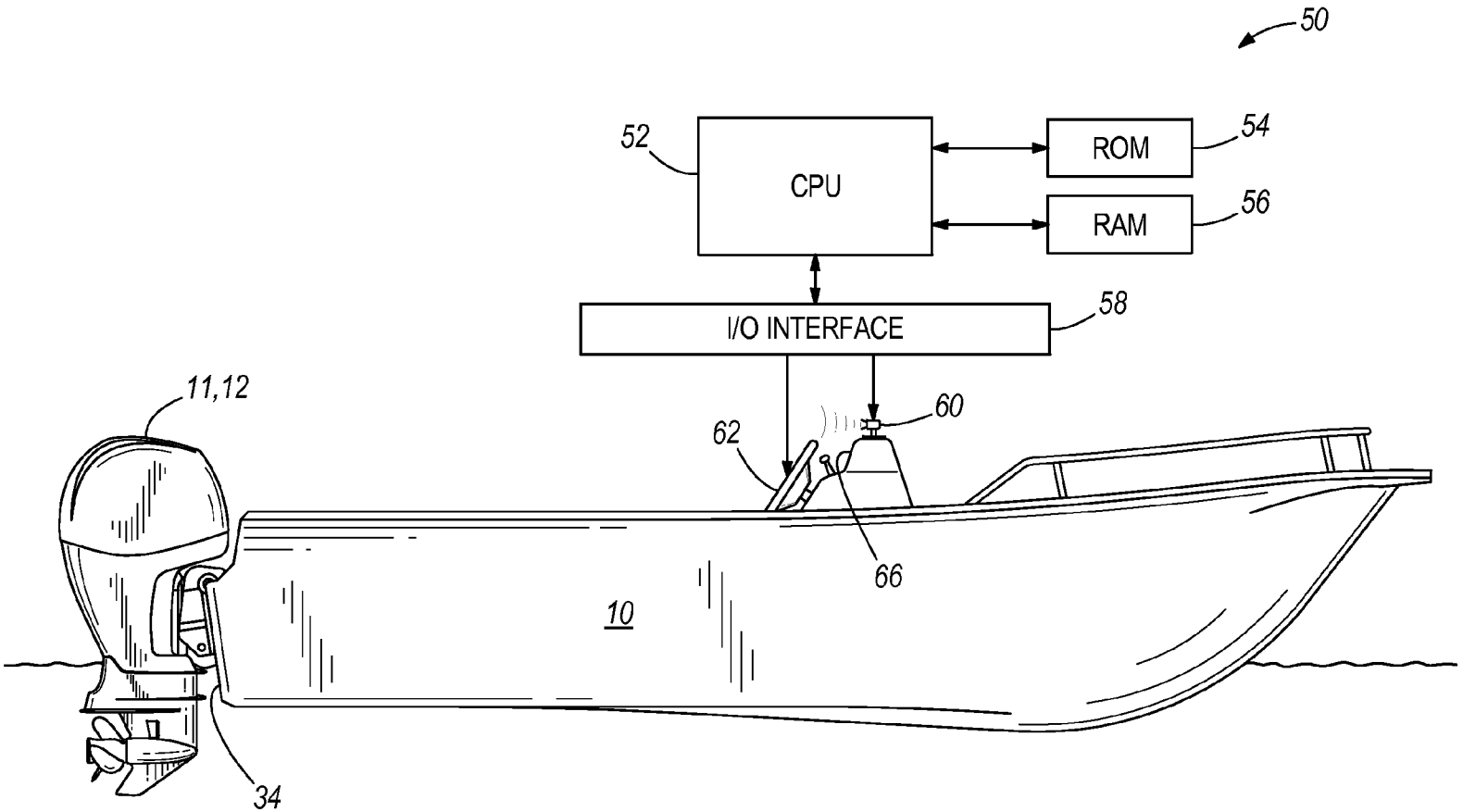
FIG. 11 is schematic view of a marine vessel with a control system.

With further reference to FIG. 11, in one embodiment, the control circuit 50 sends a notification to an operator of the marine vessel 10 that the propulsion units 11, 12 would interfere with one another or with the hull 34 of the marine vessel 10 were a certain trim angle $\beta$ or steering angle $\alpha$ for either propulsion unit 11, 12 to be executed according to the operator's command. The notification could be a visual notification sent to a user interface screen 66, or could be an audible notification sent via an audible indicator device 60. In this way, the operator is alerted that the desired movement of the propulsion units 11, 12 (input by the operator at a steering/trim angle input device 62) is not being carried out because such a command would cause interference of the propulsion units 11, 12 with one another or with the marine vessel 10. In an alternative embodiment, the operator of the marine vessel 10 is not alerted that a desired trim angle $\beta$ or steering angle $\alpha$ would cause such interference, and movement of the propulsion units 11, 12 is limited without alerting the operator of the marine vessel 10. In an alternative embodiment, the operator of the marine vessel 10 is alerted that a desired trim angle $\beta$ or steering angle $\alpha$ would cause such interference, but the control circuit 50 does not limit movement of the propulsion units 11, 12.

Several embodiments in which the control circuit 50 does limit movement of the propulsion units 11, 12 are contemplated. In one embodiment, the propulsion units 11, 12 stop moving completely. In another embodiment, the propulsion units 11, 12 are controlled to move away from one another or from the hull 34 of the marine vessel 10. In another embodiment, steering in one direction may be limited, but full trim and full steering in the opposite direction may still be allowed.

In another embodiment, the propulsion units 11, 12 can be steered in such a manner so as to avoid one another or the hull 34 of the marine vessel 10. In other words, the control circuit 50 may limit movement of a given propulsion unit 11, 12 such that movement to either a trim angle β or steering angle α is carried out, but not both. For example, if an operator requests that the first propulsion unit 11 be turned at a steering angle α1 that turns it hard to the port side 14 of the marine vessel 10 and at the same time requests that the first propulsion unit 11 be trimmed at a positive trim angle β1, the control circuit 50 may instead control the first propulsion unit 11 to avoid the hull 34 of the marine vessel 10 by steering the first propulsion unit 11 straight (with no steering angle α1) while still allowing the requested trim angle β1 to be carried out. These alternative responses to a determination that the propulsion units 11, 12 will interfere with one another or with the hull 34 are merely exemplary, and are not meant to limit the scope of the appended claims.

In the above description certain terms have been used for brevity, clearness and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A method for controlling movement of at least one propulsion unit on a marine vessel, the method comprising:

plotting a first plurality of points representing a first surface of a first propulsion unit;

plotting a second plurality of points representing a second surface;

limiting movement of at least the first propulsion unit such that the first surface does not come within a predetermined distance of the second surface during said movement.

2. The method according to claim 1, further comprising:

calculating a distance between each of the points in the first plurality of points and the second surface as a function of a position of at least the first propulsion unit; and calculating a distance between each of the points in the second plurality of points and the first surface as a function of the position of at least the first propulsion unit.

3. The method according to claim 2, wherein the second surface is a surface of a second propulsion unit.

4. The method according to claim 3, further comprising plotting the first and second pluralities of points in three dimensions.

5. The method according to claim 4, further comprising plotting the first and second pluralities of points as a function of trim angles and steering angles of the first and second propulsion units.

6. The method according to claim 5, wherein the first surface comprises a first plane along a side of the first propulsion unit that is adjacent the second propulsion unit, and wherein the second surface comprises a second plane along a side of the second propulsion unit that is adjacent the first propulsion unit.

7. The method according to claim 6, wherein when both the trim angles and steering angles of the first and second propulsion units are zero, the second plane is parallel to the first plane.

8. The method according to claim 6, further comprising calculating distances between each of the points in the first plurality of points and the second plane and calculating distances between each of the points in the second plurality of points and the first plane as a function of requested trim angles and steering angles of the first and second propulsion units.

9. The method according to claim 8, further comprising limiting movement of at least one of the first and second propulsion units when a distance between any one of the points in the first plurality of points and the second plane has a sign that is different than the signs of the distances between any of the remaining points in the first plurality of points and the second plane, or when a distance between any one of the points in the second plurality of points and the first plane has a sign that is different than the signs of the distances between of any of the remaining points in the second plurality of points and the first plane.

10. The method according to claim 8, further comprising limiting movement of at least one of the first and second propulsion units when the absolute value of the distance between any one of the points in the first plurality of points and the second plane is less than a predetermined threshold, or when the absolute value of the distance between any one of the points in the second plurality of points and the first plane is less than the predetermined threshold.

11. The method according to claim 5, wherein one of the points in the first plurality of points does not change as a function of one of the steering angle and the trim angle of the first propulsion unit.

12. The method according to claim 11, wherein the one of the points in the first plurality of points is on an axis of a trim pivot tube of the first propulsion unit.

13. A control system for controlling movement of at least one propulsion unit on a marine vessel, the control system comprising:

a control circuit that plots a first plurality of points representing a first surface of a first propulsion unit and plots a second plurality of points representing a second surface;

wherein the control circuit limits movement of at least the first propulsion unit such that the first surface does not come within a predetermined distance of the second surface during said movement.

14. The control system of claim 13, wherein the control circuit:

calculates a distance between each of the points in the first plurality of points and the second surface as a function of a position of at least the first propulsion unit; and calculates a distance between each of the points in the second plurality of points and the first surface as a function of the position of at least the first propulsion unit.

15. The control system of claim 14, wherein the second surface is a surface of a second propulsion unit.

16. The control system of claim 15, wherein the control circuit plots the first and second pluralities of points in three dimensions.

17. The control system of claim 16, wherein the control circuit plots the first and second pluralities of points as a function of trim angles and steering angles of the first and second propulsion units.

18. The control system of claim 17, wherein the first surface comprises a first plane along a side of the first propulsion unit that is adjacent the second propulsion unit, and wherein the second surface comprises a second plane along a side of the second propulsion unit that is adjacent the first propulsion unit.

19. The control system of claim 18, wherein when both the trim angles and steering angles of the first and second propulsion units are zero, the second plane is parallel to the first plane.

20. The control system of claim 19, wherein the control circuit calculates distances between each of the points in the first plurality of points and the second plane and calculates distances between each of the points in the second plurality of points and the first plane as a function of requested trim angles and steering angles of the first and second propulsion units.

21. The control system of claim 20, wherein the control circuit limits movement of at least one of the first and second propulsion units when a distance between any one of the points in the first plurality of points and the second plane has a sign that is different than the signs of the distances between any of the remaining points in the first plurality of points and the second plane, or when a distance between any one of the points in the second plurality of points and the first plane has a sign that is different than the signs of the distances between of any of the remaining points in the second plurality of points and the first plane.

22. The control system of claim 20, wherein the control circuit limits movement of at least one of the first and second propulsion units when the absolute value of the distance between any one of the points in the first plurality of points and the second plane is less than a predetermined threshold, or when the absolute value of the distance between any one of the points in the second plurality of points and the first plane is less than the predetermined threshold.

23. The control system of claim 17, wherein one of the points in the first plurality of points does not change as a function of one of the steering angle and the trim angle of the first propulsion unit.

24. The control system of claim 23, wherein the one of the points in the first plurality of points is on an axis of a trim pivot tube of the first propulsion unit.

25. A method for controlling movement of at least one propulsion unit on a marine vessel, the method comprising limiting movement of at least a first propulsion unit and a second propulsion unit based on trim angles of the first and second propulsion units, steering angles of the first and second propulsion units, a drive separation distance between the first and second propulsion units, and dimensions of the first and second propulsion units.

* * * * *